US011118278B2

(12) United States Patent
Emesh et al.

(10) Patent No.: US 11,118,278 B2
(45) Date of Patent: Sep. 14, 2021

(54) ENHANCED PLATING BATH AND ADDITIVE CHEMISTRIES FOR COBALT PLATING

(71) Applicant: Applied Materials, Inc., Santa Clara, CA (US)

(72) Inventors: Ismail Emesh, Sunnyvale, CA (US); Roey Shaviv, Palo Alto, CA (US); Chris Pabelico, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 71 days.

(21) Appl. No.: 16/656,026

(22) Filed: Oct. 17, 2019

(65) Prior Publication Data

US 2020/0048784 A1 Feb. 13, 2020

Related U.S. Application Data

(62) Division of application No. 15/419,430, filed on Jan. 30, 2017, now Pat. No. 10,487,410.

(60) Provisional application No. 62/300,159, filed on Feb. 26, 2016.

(51) Int. Cl.

| | |
|---|---|
| ***C25D 5/00*** | (2006.01) |
| ***C25D 5/02*** | (2006.01) |
| ***C25D 3/18*** | (2006.01) |
| ***C25D 7/12*** | (2006.01) |

(52) U.S. Cl.

CPC ..... *C25D 3/18* (2013.01); *C25D 7/123* (2013.01)

(58) Field of Classification Search

CPC . C25D 3/18; C25D 5/02; C25D 7/123; C25D 5/00

USPC ..... 205/269, 118, 123

See application file for complete search history.

(56) References Cited

U.S. PATENT DOCUMENTS

| | | | |
|---|---|---|---|
| 4,016,051 | A | 4/1977 | Geldzahler et al. |
| 4,102,755 | A | 7/1978 | Brugger et al. |
| 6,379,522 | B1 | 4/2002 | Landau et al. |
| 6,544,399 | B1 | 4/2003 | Landau et al. |
| 6,596,151 | B2 | 7/2003 | Landau et al. |

(Continued)

FOREIGN PATENT DOCUMENTS

| | | | |
|---|---|---|---|
| TW | 200724716 | A | 7/2007 |
| WO | 9954527 | A2 | 10/1999 |

(Continued)

OTHER PUBLICATIONS

Office Action for Taiwan Application No. 106104035 dated Jul. 28, 2020.

(Continued)

*Primary Examiner* — Edna Wong

(74) *Attorney, Agent, or Firm* — Patterson + Sheridan, LLP

(57) ABSTRACT

Implementations of the disclosure may include methods of electroplating features formed on a semiconductor device, such as the trenches and vias formed by single or dual Damascene processes using a cobalt plating bath. The cobalt electroplating bath may contain "additive packages" or "additive systems" that include a combination of additives in certain ratios that facilitate the metal filling of high aspect ratio sub-micrometer features. Implementations of the disclosure provide new cobalt plating bath methods and chemistries and that include alkyl modified imidazoles, imidazolines, and imidazolidines suppressor compounds.

20 Claims, 2 Drawing Sheets

(56) References Cited

U.S. PATENT DOCUMENTS

| | | | | |
|---|---|---|---|---|
| 6,610,191 | B2 | 8/2003 | Landau et al. | |
| 7,758,681 | B2 | 7/2010 | Lee et al. | |
| 10,487,410 | B2 * | 11/2019 | Emesh | C25D 3/18 |
| 2002/0011416 | A1 | 1/2002 | Landau et al. | |
| 2002/0063064 | A1 | 5/2002 | Landau et al. | |
| 2003/0192785 | A1 | 10/2003 | Herdman et al. | |
| 2003/0205474 | A1 | 11/2003 | Landau et al. | |
| 2005/0008788 | A1 | 1/2005 | Joshi et al. | |
| 2007/0160857 | A1 | 7/2007 | Lee et al. | |
| 2007/0266886 | A1 | 11/2007 | En et al. | |
| 2008/0318421 | A1 | 12/2008 | Yun et al. | |
| 2013/0224514 | A1 | 8/2013 | Sugiyama et al. | |

FOREIGN PATENT DOCUMENTS

| | | | |
|---|---|---|---|
| WO | 9954527 | A3 | 10/1999 |
| WO | 0041518 | A2 | 7/2000 |
| WO | 0041518 | A3 | 7/2000 |

OTHER PUBLICATIONS

Searcg Report for Taiwan Application No. 106104035 dated Jun. 29, 2020.

P.M. Vereechken, et al. "The Chemistry of Additives in Damascene Copper Plating", vol. 49, No. 1, Jan. 2005.

International Search Report and Written Opinion for International Application No. PCT/US2017/015583 dated Jan. 30, 2017.

Office Action for U.S. Appl. No. 15/419,430 dated Feb. 5, 2019.

Final Office Action for U.S. Appl. No. 15/419,430 dated Jun. 28, 2019.

* cited by examiner

ENHANCED PLATING BATH AND ADDITIVE CHEMISTRIES FOR COBALT PLATING

CROSS-REFERENCE TO RELATED APPLICATIONS

This application is a divisional of U.S. patent application Ser. No. 15/419,430, filed Jan. 30, 2017, which claims benefit of U.S. Provisional Patent Application Ser. No. 62/300,159, filed Feb. 26, 2016, which is incorporated herein by reference in its entirety.

BACKGROUND

Field

Implementations of the present disclosure generally relate to the fabrication and cobalt metallization of integrated circuits using, for example, single and dual Damascene processes.

Description of the Related Art

Microelectronic devices, such as micro-scale electronic, electro-mechanical or optical devices are generally fabricated on and/or in work pieces or substrates, such as silicon wafers. In a typical fabrication process, for example on a semiconductor material wafer, a conductive seed layer is first applied onto the surface of the substrate using chemical vapor deposition (CVD), physical vapor deposition (PVD), electroless plating processes, or other suitable methods. After forming the seed layer, a layer of metal is plated onto the substrate by applying an appropriate electrical potential between the seed layer and one or more electrodes in the presence of an electro-processing solution containing metal ions. The substrate is then cleaned and/or annealed in subsequent procedures to form devices, contacts or conductive lines. Some substrates may have a barrier layer with the seed layer formed on the barrier layer.

Currently, most microelectronic devices are made on substrates plated with copper (Cu). Although copper has high conductivity, it typically involves a barrier layer such as tantalum nitride (TaN) to prevent diffusion of copper into the substrate or dielectric material on the substrate. These types of barrier layers have relatively low conductivity. Using known techniques, features on the substrate are filled with electroplated copper using acidic copper electroplating solutions. These electroplating solutions often use additives to promote a super-conformal fill process (with the features filling primarily from the bottom up, rather than inwardly from the sides) to create a void-free fill. As the feature sizes shrink, achieving void-free fill with the traditional copper plating processes has become more difficult. In addition, as the features get smaller, the barrier layer used for copper occupies a larger relative volume of the smaller feature, because a minimum barrier layer thickness is typically necessary to prevent copper diffusion, regardless of feature size.

For example, if a minimum barrier layer thickness of 3 nanometers is necessary to prevent diffusion of copper, then for a feature having a 60 nanometer critical dimension with an aspect ratio of 4:1, the barrier layer occupies roughly 11% of the cross-sectional area. However, with a feature having a 20 nanometer critical dimension with an aspect ratio of 2:1, the barrier layer remains 3 nanometers thick, but it now occupies 33% of the cross-sectional area. In this case the volume of the barrier layer (which has low conductivity) is proportionally higher, so the resistance of the interconnect, via or other feature is proportionally higher. With progressively smaller features, the proportion of copper to barrier layer increases, to the extent that the resistance becomes unacceptable.

One approach proposed for overcoming this technical challenge is to replace copper with a metal that does not have need of a barrier layer, such as cobalt (Co). Although cobalt has a higher resistance than copper (6 μOhm-cm versus 2 μOhm-cm), cobalt may not have need of a barrier layer to prevent diffusion into the silicon or dielectric. Chemical vapor deposition (CVD) is a useful technique for filling large and small features by applying cobalt, but has some limitations. Although this method works well for smaller features (e.g., 7-10 nm), such as interconnect level features or contact level features, CVD is not well suited for filling features larger than about 10 nm.

Therefore, new techniques are needed for the super-conformal and defect free filling of narrow features with cobalt, such as improved cobalt electroplating baths that contain new and improved plating bath additives.

SUMMARY

Implementations of the present disclosure generally relate to the fabrication and cobalt metallization of integrated circuits using, for example, single and dual Damascene processes. Implementations of the present disclosure include an additive system for electroplating a cobalt layer on a substrate containing at least one suppressor compound. The suppressor compound comprises an imidazole, imidazoline, or imidazolidine group. The imidazole, imidazoline, or imidazolidine group has an alkyl group. The alkyl group is bound to an aromatic ring or aliphatic ring, and/or wherein the alkyl group is bound to an atom that is exo or external to a ring atom. The additive system of this disclosure may have an alkyl group selected from aromatic alkyl groups, aliphatic alkyl groups, oxidized carbon groups, ether groups, ethoxy groups, propoxy groups, ethylene glycol groups, diethylene glycol groups, propylene glycol groups, dipropylene glycol groups, primary, secondary, or tertiary amine groups, thioether groups, and thiol groups.

The aforementioned alkyl group may be oligomeric or polymeric, and may have at least two repeat units. The aforementioned alkyl group may be linear, cyclic, branched, dendritic, or combinations thereof. The alkyl group may be a polyethylene glycol group, wherein the polyethylene glycol group is of a molecular weight from between about 100 g/mole to about 30,000 g/mole, or the alkyl group may be a polypropylene glycol. Additionally, the alkyl group may have at least one of the heteroatoms selected from N, P, O, and/or S. The additive system has a pH that is at least 4, such as a pH of between 4 and 9, such as a pH of about 7.

Implementations of the present disclosure may use a suppressor that is complexed to a cobalt metal ion, or one that is complexed to a cobalt metal surface. The cobalt metal ion complex is the reaction product of the suppressor molecule and the cobalt ion, and the cobalt metal complex is the reaction product of the suppressor molecule and the cobalt surface.

Also described in the present disclosure is a method of forming a cobalt electroplating bath. The method includes dispensing a first amount of a cobalt ion source into a first vessel; dispensing a first amount of at least one suppressor compound in the first vessel, wherein the suppressor compound comprises an imidazole, imidazoline, or imidazolidine group, and the imidazole, imidazoline, or imidazolidine group comprises an alkyl ether group. The method further includes adjusting the electroplating bath pH to between about 4 and about 9. Also described herein is a method wherein the pH is at least 5.

Another method of forming a cobalt layer on a substrate is also described. The method includes immersing a substrate having a conductive layer disposed thereon in a cobalt plating bath, wherein the cobalt plating bath contains a first amount of a cobalt ion and a first amount of at least one suppressor compound. The suppressor compound comprises an imidazole, imidazoline, or imidazolidine group, and the imidazole, imidazoline, or imidazolidine group comprises an alkyl ether group. The method further includes biasing the conductive layer relative to an anode that is in electrical communication with the cobalt plating bath and the conductive layer to form a cobalt layer on the surface of the conductive layer. The method also includes a pH of the cobalt plating bath that is at least 4, such as a pH of between 4 and 9.

BRIEF DESCRIPTION OF THE DRAWINGS

So that the manner in which the above-recited features of the present disclosure can be understood in detail, a more particular description of the disclosure, briefly summarized above, may be had by reference to implementations, some of which are illustrated in the appended drawings. It is to be noted, however, that the appended drawings illustrate only typical implementations of the disclosure and are therefore not to be considered limiting of its scope, for the disclosure may admit to other equally effective implementations.

Figures 1A, 1B, 1C:
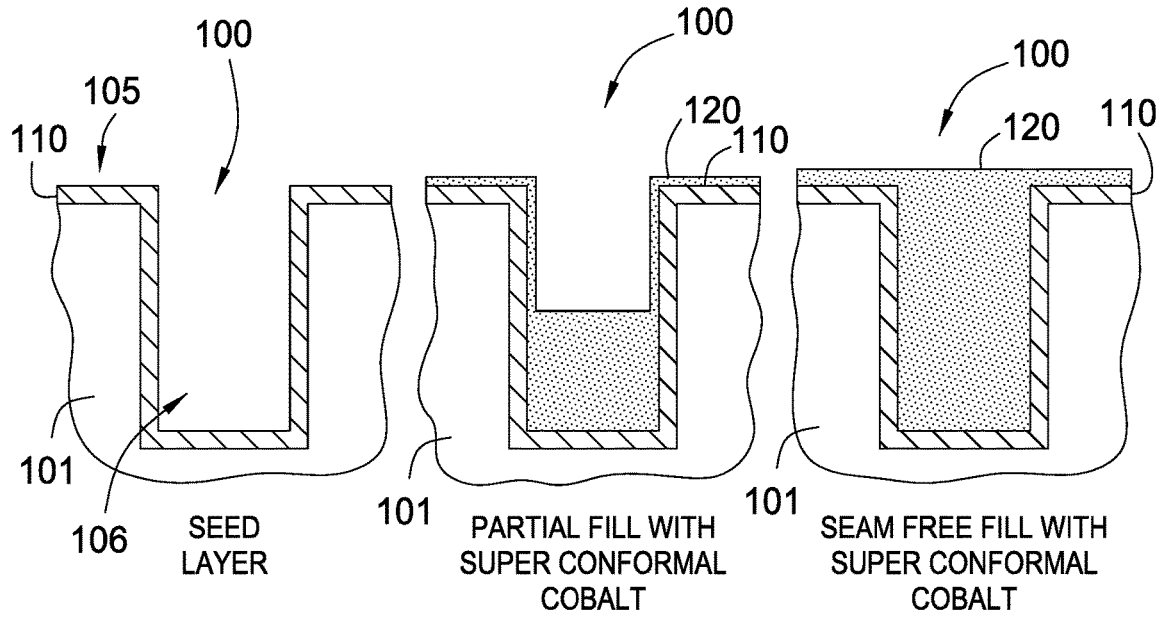
FIGS. 1A-1C is a cross-sectional view of a cobalt plating scheme according to one implementation of this disclosure.

To facilitate understanding, identical reference numerals have been used, where possible, to designate identical elements that are common to the figures. It is contemplated that elements disclosed in one implementation may be beneficially utilized on other implementations without specific recitation. The drawings referred to here should not be understood as being drawn to scale unless specifically noted. In addition, the drawings are often simplified and details or components omitted for clarity of presentation and explanation. The drawings and discussion serve to explain principles discussed below, where like designations denote like elements.

DETAILED DESCRIPTION

Implementations of the disclosure are directed to methods for cobalt electroplating and metallization of features in a semiconductor device, such as the trenches and vias formed by single or dual Damascene processes. Damascene process electroplating baths contain "additive packages" or "additive systems," wherein a combination of additives in certain ratios facilitates the metal filling of high aspect ratio submicrometer features, preferably with a low-defect density and a preferred grain structure.

Certain mixtures of additives in an additive package may promote the bottom-up filling of high aspect ratio interconnect features (such as trenches and vias) in a phenomena known as super-filling. During super-filling, the rate of metal deposition is accelerated at the bottom of the feature, while the rate of plating at the sidewalls of the feature and the top entry is suppressed or slowed. In this fashion, the trench may be filled up with a metal without being prematurely sealed off or "pinched off" by plated metal at the top of the opening, and void defects may be avoided.

In general, there are various classes of additives, including, but not restricted to: suppressers, levelers, and accelerators (or brighteners). There are a great variety of suppressors and levelers, such as a polyether, such as polyethylene glycol (PEG), polypropylene glycol (PPG) or PEG/PPG copolymers of nonionic surfactants, and/or polyvinylpyrrolidone (PVP). Suppressors may complex or coordinate to divalent metal ions, such as $Co^{2+}$, and thus shuttle the metal ion cargo into the cathodic trench and via regions of a substrate for metal super-fill deposition. Depending on the chemical structure, suppressors can control the rate of metal deposition by increasing the electrical potential for plating a metal relative to the potential for plating a metal in the absence of additives (e.g., standard potential). Suppressors may also contain heteroatoms such as oxygen, sulfur, nitrogen, and phosphorous (O, S, N, P) which can donate lone pairs of electrons to empty d-orbitals in the metal, such as the empty d-orbitals found with metal surfaces and metal ions. These compounds may also have π-bonds, which donate electron density to a metal surface and/or ion, and thus may exhibit corrosion inhibition properties, and may suppress or slow the rate of metal deposition.

Accelerators and suppressors may be small molecules, the size of which determines their migration and diffusion into, or in the vicinity of, high aspect ratio features such as trenches, where super-fill occurs. To suppress, retard, and/or mediate the metal deposition on convex or flat features or regions of the substrate, larger suppressor and/or leveler molecules may be used which cannot easily diffuse into the restrictively small openings or high aspect ratio features and thus control cobalt deposition in these areas. Considering the critical role of the suppressor and/or the metal/suppressor complex in super-fill, it would be an advantage to tune the size, molecular weight, chemical functionality, chemical groups and other aspects of such additives for "super conformal super-fill" of cobalt in Damascene or contact architectures. More specifically, in some implementations of this disclosure, new plating bath additives, such as new suppressor additives, are modified such that the compounds enable high quality, void-free cobalt fill of high aspect ratio features that serve as the conductive pathways for integrated circuits. This disclosure describes new sterically adjusted (size adjusted) suppressor molecules, with alkyl ether and other molecular substitutions, that control the rate of metal deposition at feature corners and openings, as well as over and upon the flat areas, or "field" outside or surrounding the feature. These new suppressors enable accelerated fill of high aspect ratio features and may involve synergistic interactions with cobalt ions and other additives in the bath.

Figures 2A, 2B, 2C:
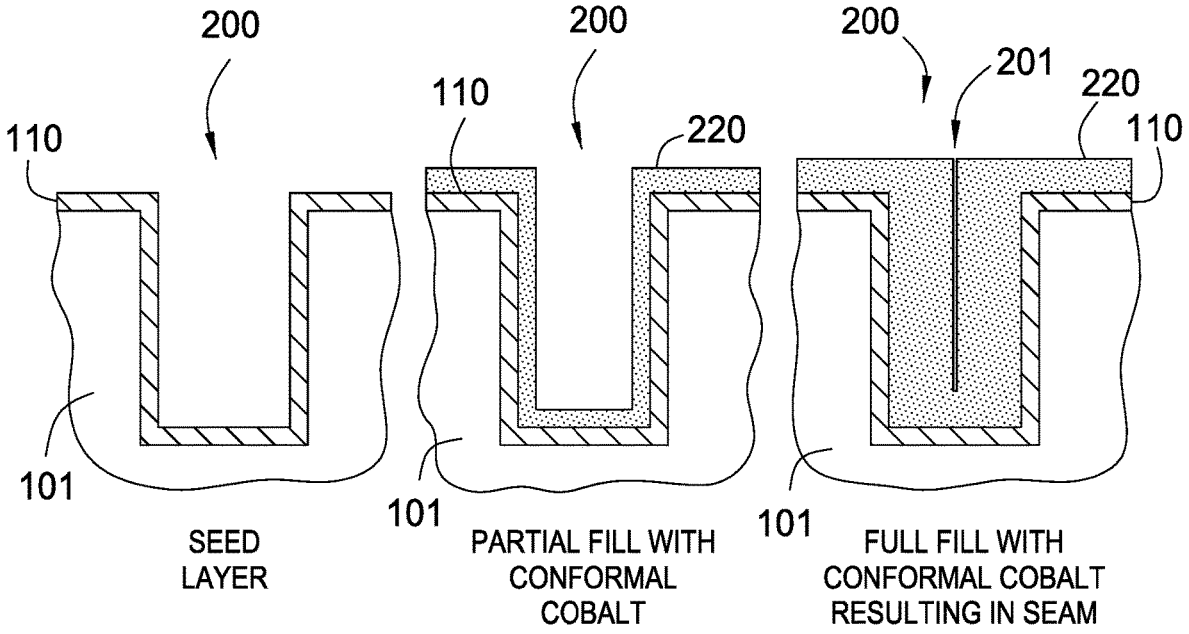
FIG. 2A (PRIOR ART) FIG. 2B (PRIOR ART) FIG. 2C (PRIOR ART)
FIGS. 2A-2C is a cross-sectional view of a prior art cobalt plating scheme.

FIGS. 1A-1C illustrates a cobalt plating process in which the additive package produces a super-filled feature(s) 100, such as a trench or via, that is void-free. As shown in FIGS. 1B-1C, the feature(s) 100 is largely filled up from the bottom, rather than inwardly from the sides, providing a seam-free plated feature. In this example, the additive package may include one or more alkyl-substituted suppressors. It is noted that bottom-up fill using the new additive package that includes the new suppressors described herein are configured such that the new suppressors are too large to suppress the fill process being performed at the bottom portion 106 of the feature, but rather mediate, modulate, and/or control cobalt deposition at the opening and on the field 105 of the substrate 101. The new chemistries may also prevent seam and other void defects 201 found in features 200 that are filled with a material 220 using conventional deposition processes found in the prior art (FIGS. 2A-2C). The filling process illustrated in FIGS. 2A-2C may also be performed by plating a conformal film followed by an annealing step, or by another layer of a super conformal film.

In other implementations of the disclosure, there may be synergistic effects observed when suppressors are mixed together, such as an acceleration of the fill process in the bottom of the features. For example, when suppressors such as 2-mercapto-benzimidazole (MBZ), mercaptopropane sulfonic acid (MPS), and (O-ethyldithiocarbonato)-S-(3-sulfopropyl)-ester sodium salt (OPX) are mixed together in a plating bath, such as a cobalt plating bath, an additive package essentially containing this suppressor combination may cause a super-fill process to occur within the feature(s) 100 formed on the surface of the substrate 101. This phenomena may depend on the selection of the individual components based on a given pH and electrochemical potential.

The plating bath additive systems described herein may be useful for plating cobalt onto substrates having small features, for example features of 60 nm, 40 nm, 30 nanometers or less, such as less than 20 nm. The substrate may be provided with a seed layer formed via electroless deposition, atomic layer deposition (ALD), physical vapor deposition (PVD), or chemical vapor deposition (CVD). Materials used in the seed layer 110 may include cobalt (Co), copper (Cu), manganese (Mn) doped copper, ruthenium (Ru), and others. The barrier layer on the substrate, if any, may be applied via physical vapor deposition (PVD), chemical vapor deposition (CVD), atomic layer deposition (ALD) or using other known deposition techniques.

In one implementation, the post etch opening of a trench in a semiconductor substrate or article may be less than 20 nm, with an aspect ratio of approximately 2-6. The feature(s) 100 may be coated with 1 nanometer to 2 nanometers thick TaN or TiN, and 1 nanometer to 6 nanometers CVD cobalt seed (e.g., seed layer 110 shown in FIG. 1A), such as about 2.5 nanometers to about 6 nanometers thick CVD cobalt layer. In another implementation, as illustrated in FIGS. 1A-1C, the feature(s) 100 may be only coated with a cobalt seed layer (e.g., seed layer 110), as cobalt has a low diffusion coefficient in silicon oxides and other commonly used dielectrics in comparison to copper.

The method of filling feature(s) 100 on a substrate 101 may further involve contacting the substrate with a cobalt electroplating plating solution (plating bath), which contains cobalt ions, and plating the cobalt on the substrate 101 so that the feature(s) 100 is filled with a cobalt containing layer 120. The cobalt solution/cobalt ion source may be introduced into the bath in the form of an aqueous salt, such as a cobalt sulfamate and/or a cobalt glycine complex in cobalt chloride, or the aforementioned cobalt sources may be added directly to the aqueous bath in a solid or liquid form in the appropriate amount. In one implementation, the concentration of cobalt ions in the bath may be between about 0.1 grams per liter (g/L) to about 15 g/L. In one implementation, the bath contains between about 0.001 moles per liter (moles/L) and about 0.25 moles/L of cobalt ions.

Figure 3:
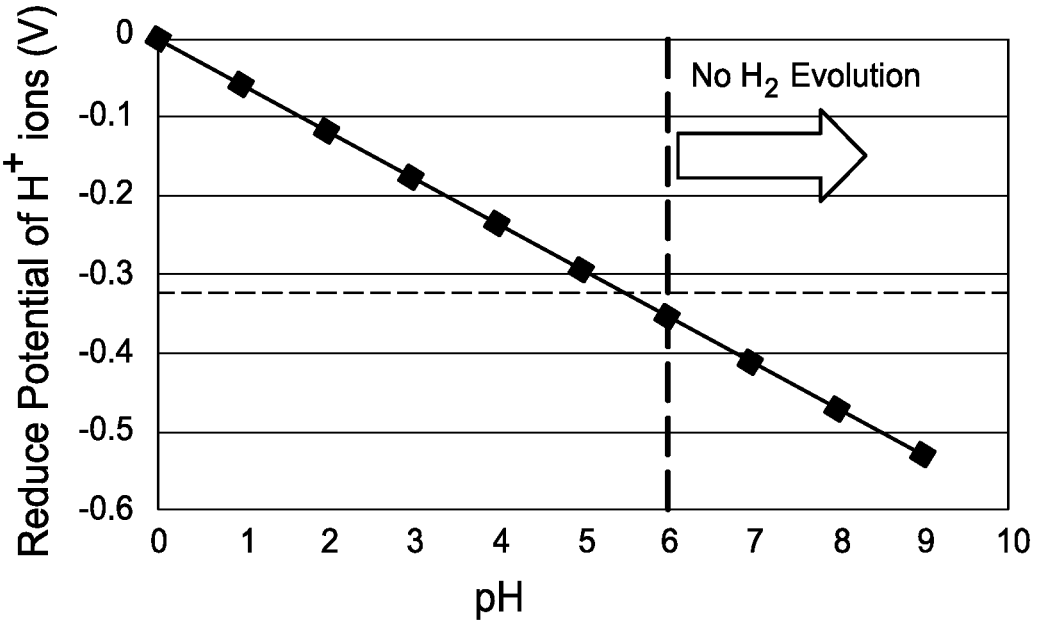
FIG. 3 graphically illustrates the effect of pH on the reduction potential of cobalt ions in a cobalt plating bath according to an implementation of the disclosure.

In another implementation, the plating bath also contains additives such as suppressors, levelers and accelerators, which may be added to the aqueous solution or bath before or after the cobalt source is added. The concentration of each of these additives may be between about 10 parts per million (ppm) and about 1000 ppm. The pH of the bath may be between about 4 and about 9, such as between about 5 and about 7. The pH may be adjusted at this juncture by adding any appropriate acid or base, so that the pH is at least 5. In one implementation, a cobalt sulfamate solution that is added to the bath may be about pH 6, and may not need further adjustment by adding a pH-adjusting component. In one implementation, a cobalt plating bath contains accelerators, levelers, suppressors, boric acid, and cobalt ions from cobalt sulfamate of a concentration from between about 0.001 moles/L to about 1 moles/L, such as between about 0.001 moles/L to about 0.25 moles/L. The pH of the bath may be about 6, and thus may not need further adjustment by adding a pH-adjusting agent. The suppressor used in such a bath may be an imidazole, imidazoline, and/or imidazolidine compound and/or alkylated derivatives thereof. It is an advantage to have a cobalt plating bath of a pH that is at least 5. Not to be bound by theory but it is believed that cobalt plating baths having a pH that is at least 5 minimize the evolution of hydrogen gas from the reduction of protons ($H^+$) in the bath during plating. As shown in FIG. 3, the potential or electromotive force (E) needed to reduce protons in a 0.25 molar $Co^{+2}$ plating bath decreases with increasing pH. The straight line plot as shown may be produced by solving the Nernst equation at a given pH.

In an alternate implementation, the cobalt solution/cobalt ion source may be formed from an aqueous salt that includes cobalt sulfate or cobalt chloride. However, it is believed that cobalt plating solutions that contain these types of cobalt ion sources are too complex to use in production and may provide inferior cobalt plating process results. Use of these types of solutions will also generally involve one or more buffering components, which can be complex and costly to manage during the process of plating multiple semiconductor substrates over the life of the bath.

In an implementation of this disclosure, a plating bath contains at least one suppressor compound that enables the defect free super-fill of cobalt in high aspect ratio features. These new compounds include alkyl modified imidazoles, imidazolines, and imidazolidines, or molecules containing imidazole, imidazoline, and/or imidazolidine groups and mixtures or combinations thereof. The chemical structures representing imidazoles, imidazolines, and imidazolidines are as illustrated by structures A-C, which may include and represent other electronic resonance forms or isomers (e.g., position of the double bond in B.), and thus do not restrict any inventive aspect of this disclosure.

A)

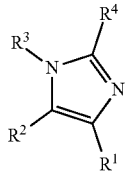

B)

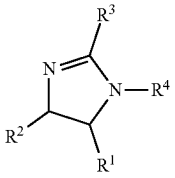

-continued

C)

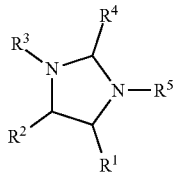

As shown, structures A-C have R groups (numbered here for illustrative purposes) that may be any carbon aliphatic or aromatic group, and/or heteroatoms including, but not restricted to H, N, P, O, and S. The R groups may be single atoms or linear, branched, or cyclic groups. In some implementations of this disclosure, suitable imidazole and/or imidazolidine molecules or imidazole groups for alkyl modification include, but are not restricted to D) 2-mercaptobenzimidazole, E) 2-mercaptoimidazole, and F) 2-imidazolidinethione, as shown.

D)

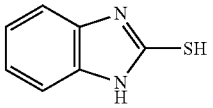

E)

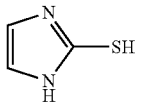

F)

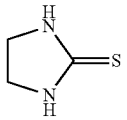

We note that the molecules D-F, as well as any suitable imidazole, imidazoline, and/or imidazolidine, may serve as synthetic building blocks, or precursors to new alkylated versions, such as G-I, which have a certain R group. Imidazoles, imidazolines, and/or imidazolidines may be modified by any appropriate synthetic method by those skilled in the art, to produce sterically hindered alkylated versions, or a pre-alkylated precursor may be converted to an alkylated imidazole, imidazoline, and/or imidazolidine.

G)

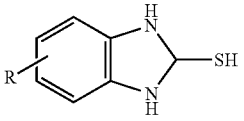

H)

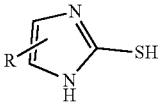

I)

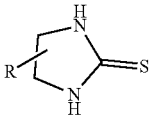

As shown, molecules G-I may contain at least one R group, which may be bound at any position on an aromatic or aliphatic ring, or in one implementation, may be exo or pendant to the ring, and may be bound to the atoms C, N, and/or S. The R group may be a group further containing aromatic groups, alkyl groups, ether groups, ethoxy groups, propoxy groups, ethylene glycol groups, diethylene glycol groups, propylene glycol groups, dipropylene glycol groups, primary, secondary, or tertiary amine groups, thioether groups and thiol groups, and may contain heteroatoms including, but not restricted to N, P, O, and S. The R group may be linear, cyclic, branched, dendritic or combinations thereof. The R group may be oligomeric or polymeric, and may contain other imidazole, imidazoline, and/or imidazolidine groups so that the molecule may be at least a dimer. The polymer groups may be random or block copolymer groups. The R group may also include terminal groups, such as hydrogen atoms, hydroxide groups, alkoxy groups, ether groups, ethoxy groups, propoxy groups, ethylene glycol groups, diethylene glycol groups, propylene glycol groups, dipropylene glycol groups, primary, secondary, or tertiary amine groups, thioether groups and thiol groups. In one implementation, the R group may be represented by an alkyl chain —$(CH_2)_x$-A, where A is a terminal group, or an alkoxy containing group, such as —(O—$CH_2)_x$-A, where A is a terminal group. There is no restriction on x in this disclosure.

In another implementation of this disclosure, the R group may be represented by —$(CH_2)_k$—B—$(CH_2)_z$—, wherein B is a group or atom including, but not restricted to, —O—, —CHOH— (methenyl hydroxide), carbonyl, —NR'— (amine, R' is H or —$CH_3$), ethylene glycol, propylene glycol, sulfur, sulfoxide, sulfone, or a —CSH group. In another implementation, the B group may also be a group such as —$(NR_2—CR_3R_4—CR_5R_6)_X$—, where X may be 1 to 4, such as 1 or 2, and where $R_2$, $R_3$, $R_4$, $R_5$ and $R_6$ may be H or —$CH_3$, or combinations thereof. In another implementation, the B group may also be a group such as —$(O—CR_7R_8—CR_9R_{10}—O)_X$—, where X may be 1 to 4, such as 1 to 2, and $R_7$, $R_8$, $R_9$, and $R_{10}$ may be H or —$CH_3$. For the implementations described, and the R group represented by —$(CH_2)_k$—B—$(CH_2)_z$—, K and Z may be the same and are integers with a value from 1 to 30.

In one implementation, as shown in structure J, the suppressor compound is a polyethylene glycol (PEG) modified mercaptobenzimidazole; wherein "n" is an integer and the molecular weight of the PEG segment may be from between about 250 g/mole to about 30,000 g/mole. The structure J may be referred to as 6-PEG-(2-mercaptobenzimidazole). It is noted that the PEG group may be bound to the molecule in any ring position, such as aromatic and aliphatic, or may be bound to a heteroatom such as N or S.

J)

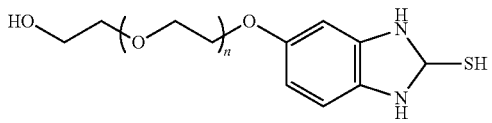

As mentioned prior, molecule J and others described in this disclosure may be sterically adjusted by the addition of an alkyl group, such as an alkyl ether group of a certain molecular weight, so that suppressor diffusion is slowed or reduced into the features. In this fashion, there may be a complementary competition between the suppressor and accelerator additives, such as stronger suppression on the substrate or article field and acceleration of cobalt plating into the features. In further implementations, useful PEG modified suppressor molecules for use in cobalt plating baths and/or additive systems include 6-PEG-(2-mercaptobenzimidazole) and it's copolymers, 6-PEG-(2-mercaptoimidazole), 6-PEG-(2-mercaptoimidazole) and it's copolymers, 6-PEG-(2-imidazolidine) and 6-PEG-(2-imidazolidine) and it's copolymers.

In summary, some of the benefits of the present disclosure include new sterically adjusted (size adjusted) suppressor molecules, with alkyl ether and other molecular substitutions, that control the rate of metal deposition at feature corners and openings, as well as over and upon the flat areas, or "field" outside or surrounding the feature. These new suppressors enable accelerated fill of high aspect ratio features and may involve synergistic interactions with cobalt ions and other additives in the bath, which reduces cost of ownership.

Thus, novel methods have been shown and described. Various changes and substitutions may of course be made with departing from the spirit and scope of the present disclosure. The present disclosure, therefore, should not be limited, except by the following claims and their equivalents.

When introducing elements of the present disclosure or exemplary aspects or implementation(s) thereof, the articles "a," "an," "the" and "said" are intended to mean that there are one or more of the elements.

The terms "comprising," "including" and "having" are intended to be inclusive and mean that there may be additional elements other than the listed elements.

While the foregoing is directed to implementations of the present disclosure, other and further implementations of the disclosure may be devised without departing from the basic scope thereof, and the scope thereof is determined by the claims that follow.

What is claimed is:

1. A method of forming a cobalt layer on a substrate, comprising:

immersing a substrate having a conductive layer disposed thereon in a cobalt plating bath, wherein the cobalt plating bath comprises:

a first amount of a cobalt ion; and a first amount of at least one suppressor compound comprising an imidazole, imidazoline, or imidazolidine group, and wherein the imidazole, imidazoline, or imidazolidine group comprises an alkyl group; and biasing the conductive layer relative to an anode that is in electrical communication with the cobalt plating bath and the conductive layer to form a cobalt layer on a surface of the conductive layer, wherein the alkyl group is an oligomeric or polymeric polypropylene glycol group.

2. The method of claim 1, wherein the polypropylene glycol group is of a molecular weight from between about 100 g/mole to about 30,000 g/mole.

3. The method of claim 1, wherein the cobalt plating bath has a pH of between about 5 and about 7.

4. The method of claim 1, wherein the first amount of the cobalt ion is introduced into the cobalt plating bath in the form of a cobalt sulfamate solution or a cobalt glycine complex containing solution, wherein a concentration of the cobalt ion in the cobalt plating bath is between about 0.001 moles/L and 0.25 moles/L.

5. The method of claim 4, wherein the first amount of the cobalt ion is introduced into the cobalt plating bath in the form of the cobalt sulfamate solution.

6. The method of claim 1, wherein the cobalt plating bath further comprises a first amount of boric acid.

7. The method of claim 1, wherein the imidazole, imidazoline, or imidazolidine group comprising the polypropylene glycol group has the structure:

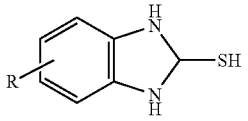

wherein the R group comprises the polypropylene glycol group.

8. The method of claim 1, wherein the imidazole, imidazoline, or imidazolidine group comprising the polypropylene glycol group has the structure:

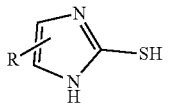

wherein the R group comprises the polypropylene glycol group.

9. The method of claim 1, wherein the imidazole, imidazoline, or imidazolidine group comprising the polypropylene glycol group has the structure:

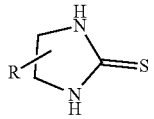

wherein the R group comprises the polypropylene glycol group.

10. The method of claim 1, wherein the substrate has a feature coated with the conductive layer.

11. The method of claim 10, wherein the conductive layer is a conductive seed layer.

12. The method of claim 11, wherein the cobalt plating bath has a pH of at least 5.

13. The method of claim 11, wherein the conductive seed layer comprises a material selected from cobalt, copper, manganese, doped copper, ruthenium, or a combination thereof.

14. The method of claim 13, wherein the feature is a trench having an opening of 30 nanometers or less.

15. The method of claim 10, wherein the first amount of the cobalt ion is from between about 0.001 moles/L and about 0.25 moles/L and the first amount of the suppressor compound is from between about 10 parts per million and about 1000 parts per million.

16. The method of claim 15, wherein the cobalt plating bath further comprises a first amount of boric acid.

17. The method of claim 10, wherein the imidazole, imidazoline, or imidazolidine group comprising the polypropylene glycol group has the structure:

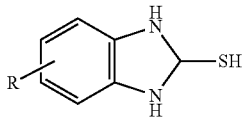

wherein the R group comprises the polypropylene glycol group.

18. The method of claim 1, wherein the substrate has a feature coated with a barrier layer and the barrier layer is coated with the conductive layer.

19. The method of claim 18, wherein the conductive layer is a conductive seed layer and the conductive seed layer comprises a material selected from cobalt, copper, manganese, doped copper, ruthenium, or a combination thereof.

20. The method of claim 18, wherein the barrier layer is a TiN layer or a TaN layer and the conductive layer is a cobalt seed layer.

* * * * *